US008021269B2

(12) United States Patent
Jung et al.

(10) Patent No.: US 8,021,269 B2
(45) Date of Patent: Sep. 20, 2011

(54) SYSTEM AND METHOD FOR MANIPULATING PORTABLE EQUIPMENT USING FOOT MOTION

(75) Inventors: Un-Suk Jung, Suwon-si (KR); Ki-Tae Lee, Seoul (KR); Ok-Hyeon Kim, Suwon-si (KR); Jong-Pil Shin, Seoul (KR); Sung-Pyo Yoon, Seongnam-si (KR); Jong-Hyun An, Seoul (KR)

(73) Assignee: Samsung Electronics Co., Ltd (KR)

( * ) Notice: Subject to any disclaimer, the term of this patent is extended or adjusted under 35 U.S.C. 154(b) by 672 days.

(21) Appl. No.: 11/633,239

(22) Filed: Dec. 4, 2006

(65) Prior Publication Data

US 2007/0149361 A1 Jun. 28, 2007

(30) Foreign Application Priority Data

Dec. 2, 2005 (KR) ..... 10-2005-0116902

(51) Int. Cl.
*A63B 71/00* (2006.01)
*A63B 24/00* (2006.01)

(52) U.S. Cl. ..... 482/8; 482/4

(58) Field of Classification Search ..... 482/3, 4, 482/7, 8, 9; 601/27; 73/379.01; 702/160; 434/250

See application file for complete search history.

(56) References Cited

U.S. PATENT DOCUMENTS

| | | | | |
|---|---|---|---|---|
| 4,578,769 | A * | 3/1986 | Frederick | 702/160 |
| 4,660,305 | A * | 4/1987 | Medler et al. | 36/139 |
| 4,703,445 | A * | 10/1987 | Dassler | 702/160 |
| 5,139,261 | A * | 8/1992 | Openiano | 463/36 |
| 5,461,188 | A * | 10/1995 | Drago et al. | 84/600 |
| 5,467,652 | A * | 11/1995 | Richards | 73/379.01 |
| 5,615,111 | A * | 3/1997 | Raskas et al. | 36/136 |
| 5,714,706 | A * | 2/1998 | Nakada et al. | 84/730 |
| 5,855,080 | A * | 1/1999 | Van Staden | 36/139 |
| 6,315,571 | B1 * | 11/2001 | Lee | 434/250 |
| 6,326,539 | B1 * | 12/2001 | Mishima | 84/723 |
| 6,356,856 | B1 * | 3/2002 | Damen et al. | 702/160 |
| 6,358,187 | B1 * | 3/2002 | Smith | 482/4 |
| 6,428,449 | B1 * | 8/2002 | Apseloff | 482/3 |
| 6,430,843 | B1 * | 8/2002 | Potter et al. | 36/29 |
| 6,585,622 | B1 * | 7/2003 | Shum et al. | 482/8 |
| 7,188,439 | B2 * | 3/2007 | DiBenedetto et al. | 36/132 |
| 7,225,565 | B2 * | 6/2007 | DiBenedetto et al. | 36/132 |
| 7,373,820 | B1 * | 5/2008 | James | 73/488 |
| 7,544,880 | B2 | 6/2009 | Takai et al. | |
| 2002/0183655 | A1 * | 12/2002 | Zhang | 600/587 |
| 2006/0286972 | A1 * | 12/2006 | Kates | 455/415 |
| 2007/0006489 | A1 * | 1/2007 | Case et al. | 36/132 |

FOREIGN PATENT DOCUMENTS

| | | |
|---|---|---|
| JP | 01-167889 | 7/1989 |
| JP | 09-068973 | 3/1997 |
| KR | 20-0362439 | 9/2004 |
| KR | 1020050049345 | 5/2005 |
| KR | 1020060037642 | 5/2006 |

* cited by examiner

*Primary Examiner* — Allana Lewin
(74) *Attorney, Agent, or Firm* — The Farrell Law Firm, P.C.

(57) ABSTRACT

Provided is a system and method for manipulating portable equipment using a foot motion. The system includes a foot motion sense module for sensing a user's foot motion, and collecting sensor data based on the user's foot motion, and the portable equipment for receiving the sensor data based on the user's foot motion, recognizing the foot motion, and performing a portable equipment function in response to the foot motion recognition result.

30 Claims, 10 Drawing Sheets

SYSTEM AND METHOD FOR MANIPULATING PORTABLE EQUIPMENT USING FOOT MOTION

PRIORITY

This application claims priority under 35 U.S.C. §119 to an application entitled "System and Method for Manipulating Portable Equipment Using Foot Motion" filed in the Korean Intellectual Property Office on Dec. 2, 2005 and assigned Serial No. 2005-116902, the contents of which are incorporated herein by reference.

BACKGROUND OF THE INVENTION

1. Field of the Invention

The present invention relates generally to a system and method for manipulating portable equipment, and in particular, to a system and method for manipulating portable equipment in response to a human foot motion.

2. Description of the Related Art

Portable equipment supporting a variety of functions in addition to a call function, such as TV and music functions, is rapidly becoming more popular in place of the traditional indoor electronic appliances that provide such functions.

As this popularization occurs, consumers are requiring an ease of manipulation of these functions, creating a substantial amount of research in methods for manipulation of such portable equipment.

For example, button pressing was predominately used to activate functions in previous generation portable equipment, but touch screen or voice recognition is increasingly popular in current-generation portable equipment, to reduce button space or increase manipulations. Also, a method for manipulating portable equipment by motion recognition of an installed geomagnetic sensor or acceleration sensor is currently being used.

However, in the conventional button or touch screen methods, it is impossible to manipulate the portable equipment when a user cannot use his/her hands or is not carrying the portable equipment. Furthermore, multiple button presses can be troublesome.

In the conventional voice recognition method, when ambient noise is present, it can be difficult for voice to be recognized. This causes inconvenience of portable equipment manipulation. In the motion manipulation method, the portable equipment itself should be in motion, which is inconvenient when a user attempts to manipulate the portable equipment while viewing a display state of the in-motion portable equipment.

In view of the foregoing, there is a need for an improved manipulation method for portable equipment.

SUMMARY OF THE INVENTION

It is, therefore, an object of the present invention to provide a system and method for manipulating portable equipment in response to an external foot motion even when a user cannot use his/her hands or does not carry the portable equipment.

It is another object of the present invention to provide a system and method for manipulating portable equipment in response to an external foot motion to provide a more interesting and enjoyable method for manipulating portable equipment.

It is a further object of the present invention to provide a system and method for manipulating portable equipment in response to an external foot motion so that music can be variously expressed when a user uses an entertainment function such as a music playing function using the portable equipment.

To achieve the above and other objects, there is provided a system for manipulating portable equipment using a foot motion. The system includes a foot motion sense module for sensing a user's foot motion, and collecting sensor data based on the user's foot motion, and the portable equipment for receiving the sensor data based on the user's foot motion, recognizing the foot motion, and performing a portable equipment function depending on the foot motion recognition result.

According to the present invention, there is provided a method for manipulating portable equipment using a foot motion. The method includes sensing a user' foot motion, and collecting sensor data based on the user's foot motion, recognizing the foot motion using the sensor data based on the user's foot motion, and performing a portable equipment function in response to the foot motion recognition result.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Figure 1:
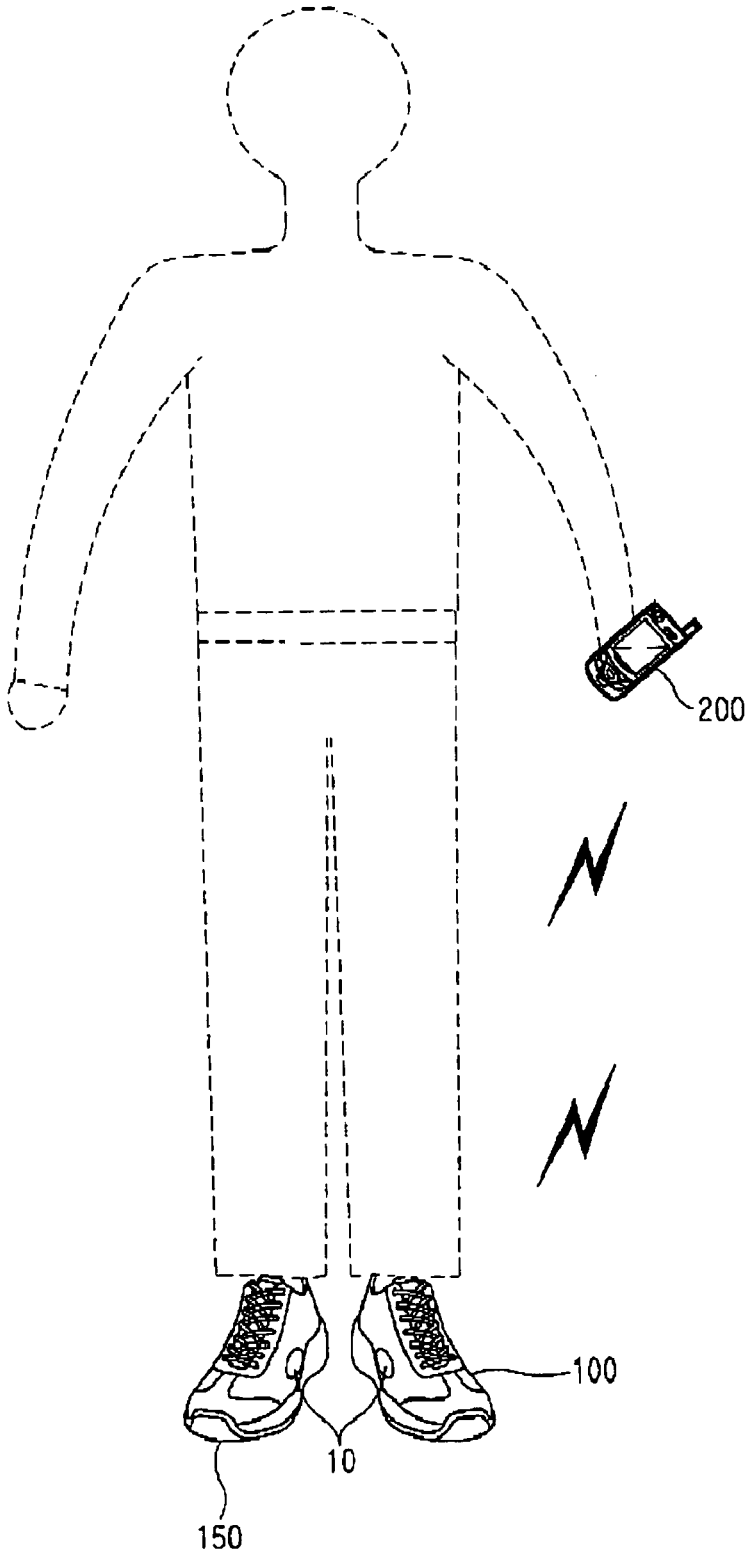
FIG. 1 illustrates a system for manipulating portable equipment using a foot motion according to the present invention.

Preferred embodiments of the present invention will now be described in detail with reference to the annexed drawings. In the drawings, the same or similar elements are denoted by the same reference numerals even though they are depicted in different drawings. In the following description, a detailed description of known functions and configurations incorporated herein has been omitted for the sake of clarity and conciseness.

FIG. 1 illustrates a system for manipulating portable equipment using a foot motion according to the present invention. Referring to FIG. 1, the system for manipulating the portable equipment using the foot motion includes a foot motion sense module 100 and the portable equipment 200.

The foot motion sense module 100 senses the user's foot motion. The foot motion sense module 100 can be of any type that is capable of sensing the user's foot motion. When a user's foot is in motion, the foot motion sense module 100 collects sensor data based on the user's foot motion, and transmits the collected sensor data to the portable equipment 200.

The portable equipment 200 refers to equipment for supporting not only a call function but also a variety of functions such as a tap dance function, a melody musical instrument playing function, and a music player function. The portable equipment 200 receives the sensor data based on the foot motion from the foot motion sense module 100, recognizes the foot motion, and is manipulated depending on the foot motion recognition result.

After recognizing the foot motion using the sensor data based on the foot motion, the foot motion sense module 100 can provide the foot motion recognition result to the portable equipment 200. The portable equipment 200 can be also manipulated, receiving the foot motion recognition result.

Constructions of the foot motion sense module 100 and the portable equipment 200 of the system for manipulating the portable equipment using the foot motion according to the present invention will be described below in detail.

Figure 2:
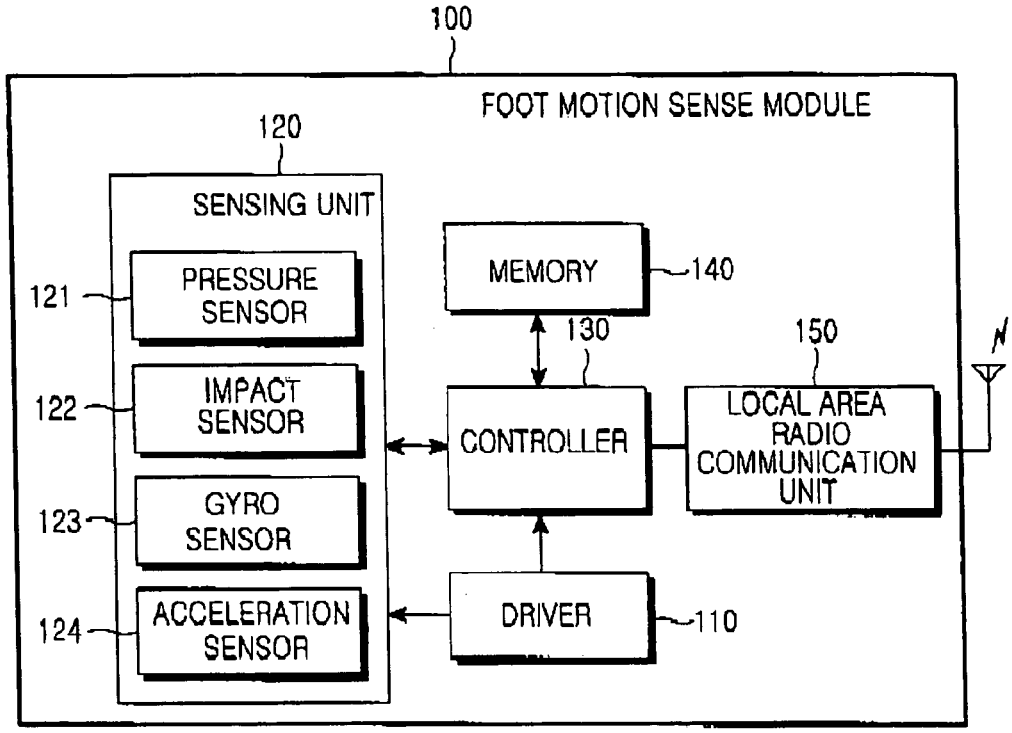
FIG. 2 is a block diagram illustrating a foot motion sense module according to the present invention.

FIG. 2 is a block diagram illustrating a construction of the foot motion sense module according to the present invention. Referring to FIG. 2, the foot motion sense module 100 includes a driver 110, a sensing unit 120, a controller 130, a memory 140 and a local area radio communication unit 150.

The driver 110 drives the foot motion sense module 100 in response to a user's request for sensing the foot motion. The request for sensing the foot motion is made by the user to request that the foot motion sense module 100 sense the foot motion, so as to manipulate the portable equipment using the foot motion. The request for sensing the foot motion can be received from the portable equipment 200, or can be recognized by the foot motion sense module 100 itself.

For example, when the portable equipment 200 generates the request for sensing the foot motion, it transmits a foot motion sense request signal to the foot motion sense module 100, and the driver 110 drives the foot motion sense module 100 in response to the foot motion sense request signal. Also, the foot motion sense module 100 itself is provided with the driver 110 comprised of a contact and/or magnetic sensor or switch, such that, the foot motion sense module 100 can be driven when there is sufficient contact therewith by the user.

For example, referring to FIG. 1, the contact and/or magnetic sensors 10 are provided inside left and right shoes. Sensing when a user bumps both feet against each other, the contact and/or magnetic sensors transmit sensed motion data to the driver 110 so that the foot motion sense module 100 can be driven.

The sensing unit 120 includes a pressure sensor 121, an impact sensor 122, a gyro sensor 123 and an acceleration sensor 124. As the foot motion sense module 100 is driven, each of the sensors outputs a sensor value based on the foot motion.

The pressure sensor 121 senses a pressure caused by the foot motion, and outputs a sensor value associated with the pressure sense result based on the foot motion. The impact sensor 122 senses an impact caused by the foot motion, and outputs a sensor value associated with the impact sense result based on the foot motion. The gyro sensor 123 senses a foot motion direction, and outputs a sensor value associated with the direction sense result based on the foot motion. The acceleration sensor 124 senses a foot motion speed, and outputs a sensor value associated with the speed sense result based on the foot motion.

As the foot motion sense module 100 is driven, the controller 130 receives each of the sensor values of the sensing unit 120, and collects and transmits the sensor data based on the foot motion to the portable equipment 200 through the local area radio communication unit 150. After recognizing the foot motion using the respective sensor values of the sensing unit 120, the controller 130 can also transmit the foot motion recognition result to the portable equipment 200.

The memory 140 temporarily stores the sensor data based on the foot motion, or stores program for transmitting the sensor data based on the foot motion to the portable equipment 200. When the controller 130 recognizes the foot motion, the memory 140 can also store information for foot motion recognition provided from the respective sensor data.

The local area radio communication unit 150 can include an infrared communication module, a ZigBee™ communication module, and a Bluetooth® communication module, and performs a local area radio communication with the portable equipment 200. Under the control of the controller 130, the local area radio communication unit 150 transmits the sensor data based on the foot motion to the portable equipment 200, or transmits the foot motion recognition result provided from the foot motion sensor data, to the portable equipment 200.

According to the present invention, the foot motion sense module 100 can be of a special shoe type, and can be built in the shoe or can be installed as a separate device in the shoe.

Figure 3A:
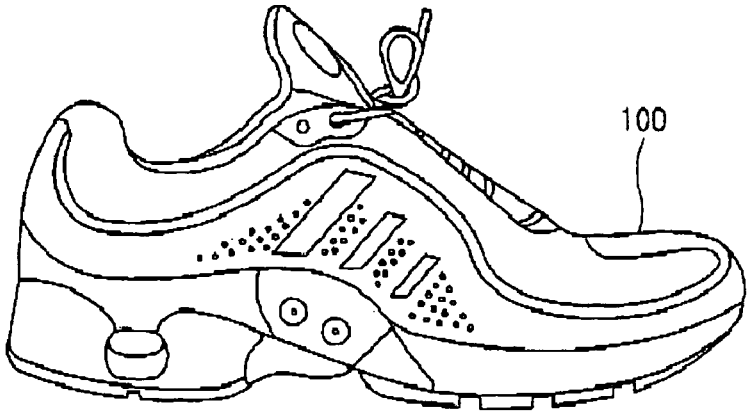
FIG. 3A illustrates a shoe provided with a foot motion sense module according to the present invention.
Figure 3B:
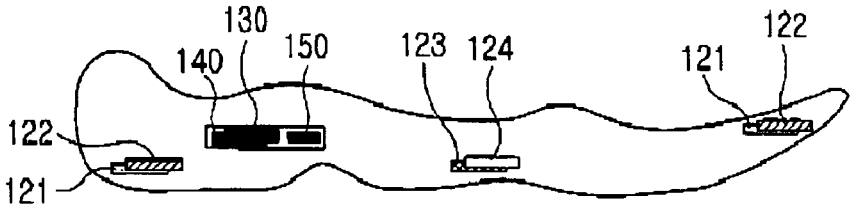
FIG. 3B illustrates a side view of the sole of a shoe provided with a foot motion sense module according to the present invention.
Figure 3C:
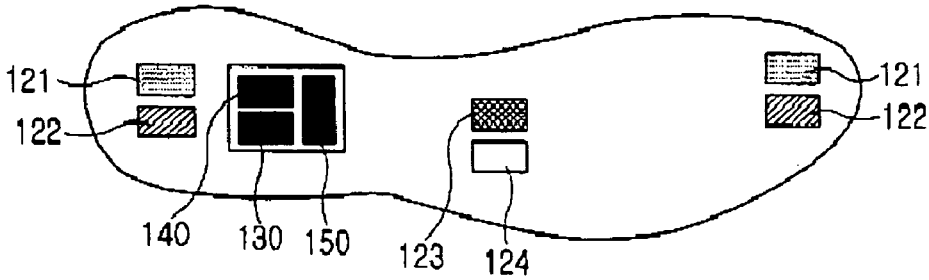
FIG. 3C illustrates a top view of the sole of a shoe provided with a foot motion sense module according to the present invention.

FIG. 3 illustrates an example of a shoe provided with the foot motion sense module 100 according to the present invention. FIG. 3A is a side view illustrating the shoe provided with the foot motion sense module 100 according to the present invention. FIG. 3B is a side view illustrating a sole of the shoe provided with the foot motion sense module 100 according to the present invention. FIG. 3C is a top view illustrating a sole of the shoe provided with the foot motion sense module 100 according to the present invention.

Referring to FIGS. 3A and 3B, the sensors 121 to 124, the controller 130, the memory 140, and the local area radio communication module 150 of the foot motion sense module 100 are positioned at a sole portion of the shoe.

Referring to FIG. 3C, the pressure sensor 121 and the impact sensor 122 are positioned correspondingly to respective heel and toe portions of the shoe sole, to accurately sense the pressure and impact applied to the foot. The gyro sensor 123 and the acceleration sensor 124 can be positioned correspondingly to a center portion of the sole, to accurately sense the foot motion speed and direction. The controller 130, the memory 140 and the local area radio communication module 150 can be disposed between the heel portion and the center portion of the sole having the least influence from the pressure and the impact.

Figure 4:
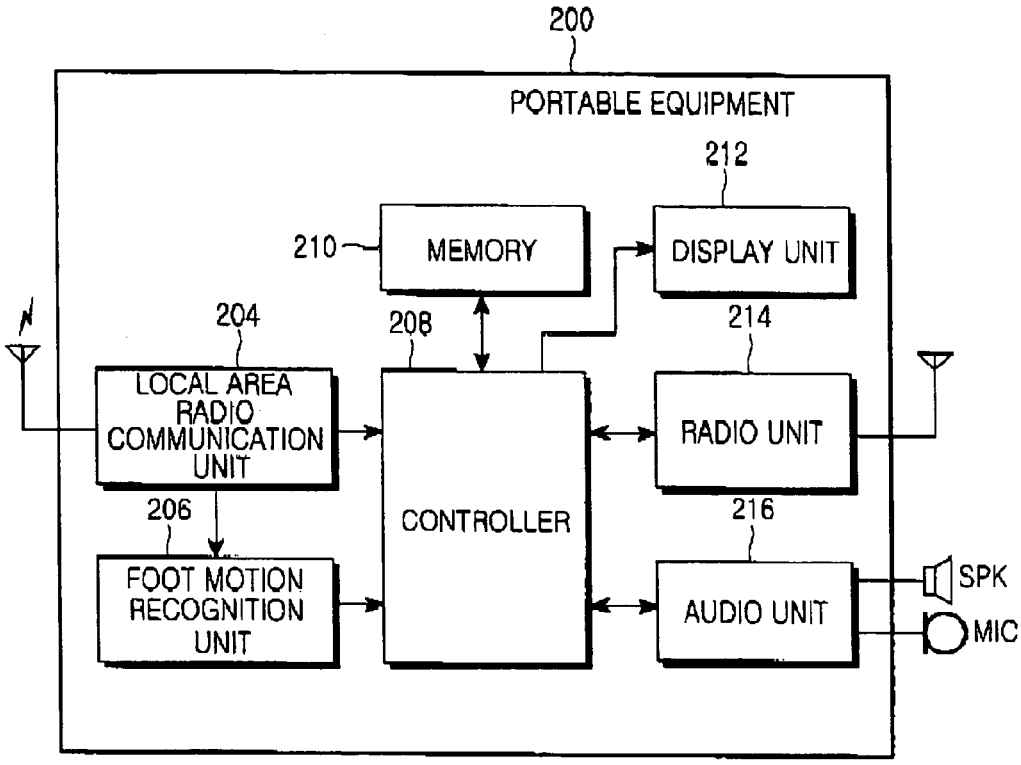
FIG. 4 is a block diagram illustrating portable equipment according to the present invention.

FIG. 4 is a block diagram illustrating the portable equipment 200 according to the present invention. Referring to FIG. 4, the portable equipment 200 includes a local area radio communication unit 204, a foot motion recognition unit 206, a controller 208, a memory 210, a display unit 212, a radio unit 214 and an audio unit 216.

The local area radio communication unit 204 may include any one of an infrared communication module, a ZigBee™ communication module and a Bluetooth® communication module, and performs a local area radio communication with the foot motion sense module 100. The local area radio communication unit 204 receives the sensor data based on the foot motion, or receives the foot motion recognition result from the foot motion sense module 100.

The foot motion recognition unit 206 recognizes the foot motion, using the sensor data based on the foot motion that is received using the local area radio communication unit 204, and outputs the foot motion recognition result to the controller 208. The foot motion recognition unit 206 can recognize single or plural foot motions. The single foot motion literally refers to one foot motion, while the plural foot motion refers to two or more foot motions.

Figure 5A:
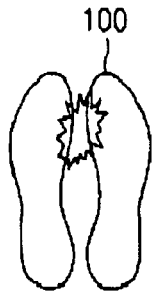
FIGS. 5A to 5F are examples of single foot motions according to the present invention.
Figure 5B:
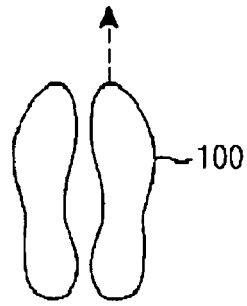
Figure 5C:
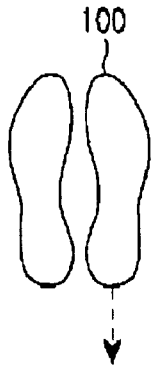
Figure 5D:
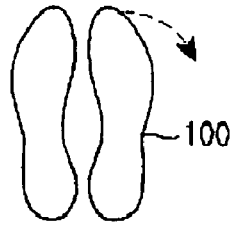
Figure 5E:
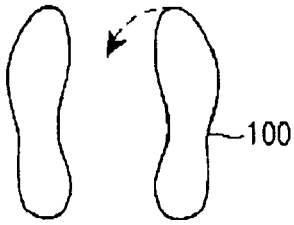
Figure 5F:
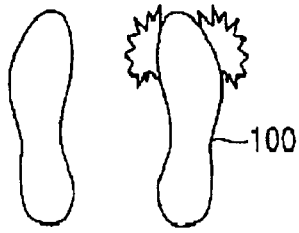

FIGS. 5A to 5F are examples of the single foot motion according to the present invention. FIG. 5A shows a motion of bumping both feet against each other. FIG. 5B shows a motion of stepping a foot forward in a straight line. FIG. 5C shows a motion of stepping a foot backward in a straight line. FIG. 5D shows a motion of turning a foot clockwise. FIG. 5E shows a motion of turning a foot counterclockwise. FIG. 5F shows a motion of stomping a foot.

Figure 6A:
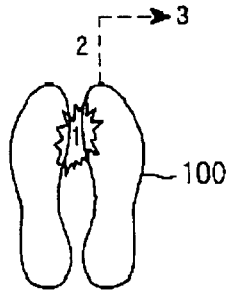
FIGS. 6A to 6G are examples of plural foot motions according to the present invention.
Figure 6B:
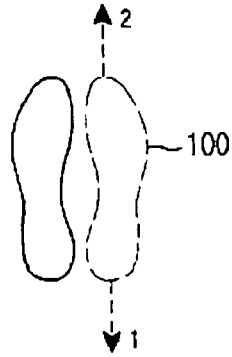
Figure 6C:
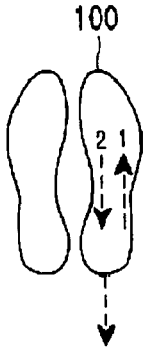
Figure 6D:
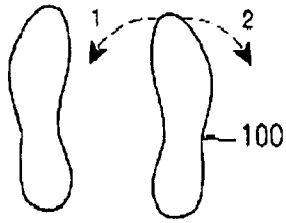
Figure 6E:
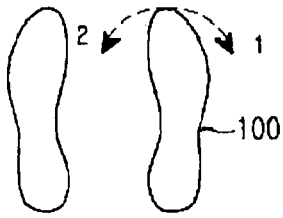
Figure 6F:
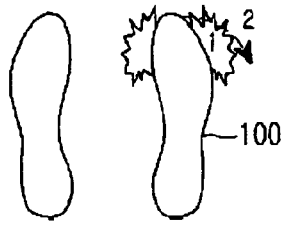
Figure 6G:
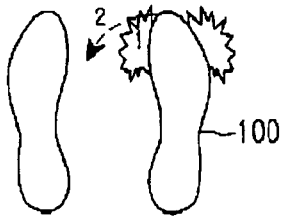

FIGS. 6A to 6G are examples of plural foot motions according to the present invention. FIG. 6A shows a motion of bumping both feet against each other (1), stepping a foot forward in a straight line (2), and turning a foot to the right (3). FIG. 6B shows a motion of lifting a foot up (1) and down (2). FIG. 6C shows a motion of stepping a foot forward (1) and backward (2) in a straight line. FIG. 6D shows a motion of turning a foot counterclockwise (1) and clockwise (2). FIG. 6E shows a motion of turning a foot clockwise (1) and counterclockwise (2). FIG. 6F shows a motion of stomping (1) and turning a foot to the right (2). FIG. 6G shows a motion of stomping (1) and turning (2) a foot to the left.

Referring back to FIG. 4, the foot motion recognition unit 206 previously stores a sensor critical value based on each of the single and plural foot motions, and recognizes execution of the foot motion when a sensor data value corresponds to any one of the previously stored sensor critical values based on the single and plural foot motions.

The controller 208 receives the foot motion recognition result using the local area radio communication unit 204 or the foot motion recognition unit 206, and performs a portable equipment function in response to the foot motion recognition result. The controller 208 performs a portable equipment manipulation command or function corresponding to the recognized foot motion, using previously stored portable equipment manipulation command or function information corresponding to each foot motion.

In other words, if any one of the single foot motions of FIGS. 5A to 5F and the plural foot motions of FIGS. 6A to 6G is recognized, the controller 208 performs the manipulation command or function, depending on the previously stored portable equipment manipulation command or function information corresponding to the recognized foot motion. For example, the controller 208 can perform a tap dance function, the melody musical instrument playing function and the music player function, depending on the foot motion.

The memory 210 temporarily stores the sensor data based on the foot motion received from the foot motion sense module 100, or stores the information for foot motion recognition provided from each sensor data. The memory 210 stores a plurality of programs and data for performing a variety of functions such as the tap dance, the melody musical instrument playing and the music player functions. Herein, the tap dance function refers to creating tap dance music using the user's foot motion. The melody musical instrument playing function refers to creating melody music using the user's foot motion. The music player function refers to enabling a music player using the user's foot motion.

The memory 210 stores a portable equipment manipulation command or function execution command corresponding to each foot motion. The portable equipment manipulation command or function information corresponding to each foot motion can be designated and stored by the user, or can be designated and stored by a manufacturer when the system for manipulating the portable equipment is manufactured.

The display unit 212 can include a liquid crystal display (LCD). The display unit 212 displays display data that is generated in execution of the function using the foot motion recognition according to the present invention.

The radio unit 214 communicates a radio signal with a mobile communication base station, provides the received radio signal to the controller 208, and transmits the radio signal from the controller 208 to the mobile communication base station, thereby enabling a mobile communication function.

The audio unit 216 connects with a microphone and a speaker. Under the control of the controller 208, the audio unit 216 converts an analog audio signal received from the microphone into digital audio data, and outputs the converted audio data to the controller 208. The audio unit 216 converts digital audio data received from the controller 208 into an analog audio signal, and outputs the converted audio signal through the speaker.

Figure 7:
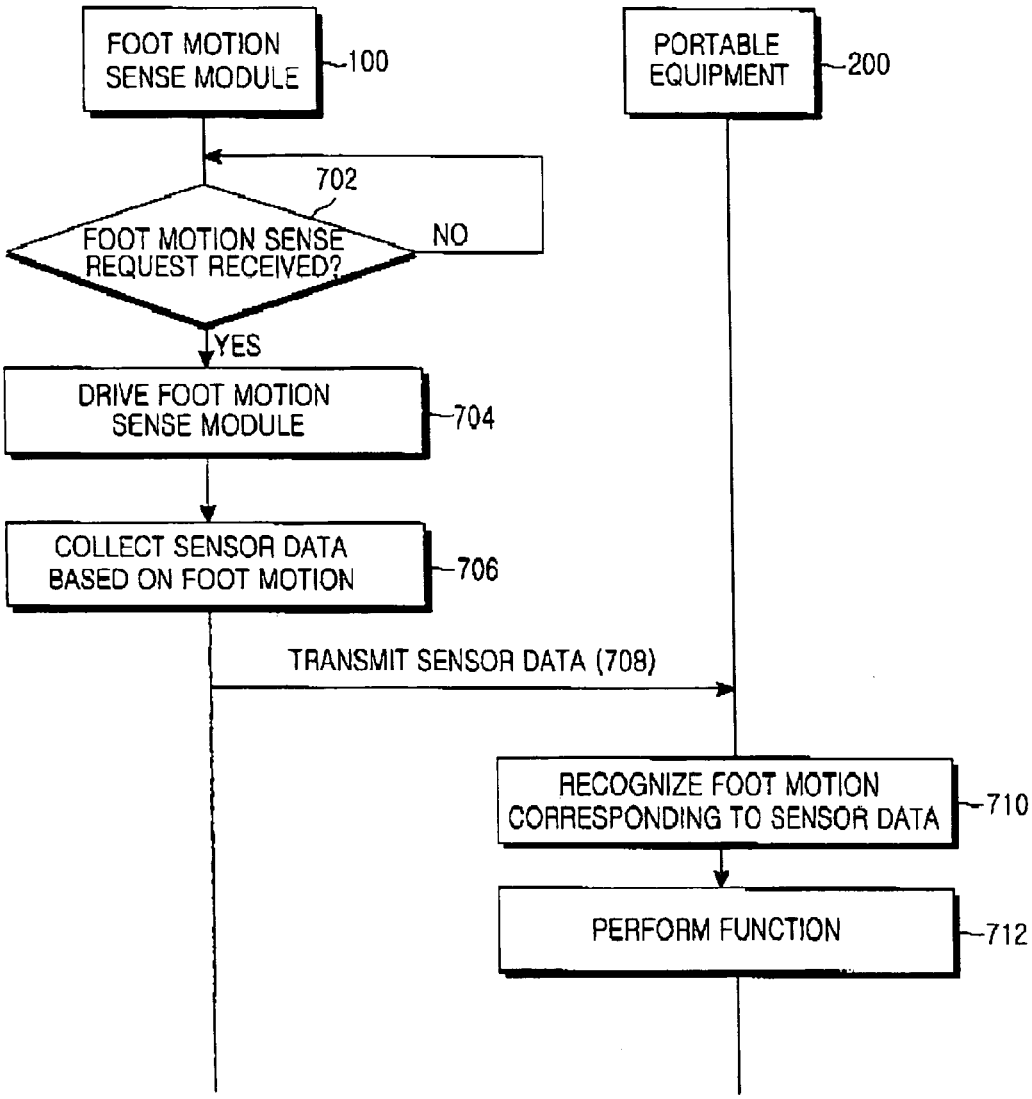
FIG. 7 is a ladder diagram illustrating an operation of a system for manipulating portable equipment using a foot motion according to the present invention.

FIG. 7 is a ladder diagram illustrating the operation of the system for manipulating the portable equipment using the foot motion according to the present invention.

Referring to FIG. 7, in Step 702, the foot motion sense module 100 determines whether the user's request for sensing the foot motion is received. The request for sensing the foot motion is made by the user to request the foot motion sense module 100 to sense the foot motion so as to manipulate the portable equipment using the foot motion. The request for sensing the foot motion can be received from the portable equipment 200, or can be recognized by the driver 110 of the foot motion sense module 100 itself.

When the portable equipment 200 generates the request for sensing the foot motion, it transmits the foot motion sense request signal to the foot motion sense module 100. The foot motion sense module 100 is provided with the driver 110 including the contact and/or magnetic sensor or switch, and when there is sufficient contact by the user, the foot motion sense module 100 recognizes it as the foot motion sense request. Upon the receipt of the user's foot motion sense request, in Step 704, the foot motion sense module 100 drives its sensing unit 120 and controller 130 using the driver 110.

When the sensor unit 120 and the controller 130 are driven as above, in Step 706, the foot motion sense module 100 collects the sensor data based on the foot motion using the sensing unit 120. For example, the foot motion sense module 100 collects pressure sensor data, impact sensor data, geomagnetic sensor data and acceleration sensor data based on the foot motion, using the sensing unit 120.

In Step 708, the foot motion sense module 100 transmits the respective collected sensor data to the portable equipment 200 using the local area radio communication. The foot motion sense module 100 can use the local area radio communication such as infrared communication, ZigBee™ communication and Bluetooth® communication.

The portable equipment 200 receives the sensor data from the foot motion sense module 100, and recognizes the foot motion corresponding to the sensor data in Step 710. For example, the portable equipment 200 stores the sensor critical value for the previously designated foot motion, and recognizes the previously designated foot motion when the received sensor data corresponds to the previously stored sensor critical value. The previously designated foot motion can be the single foot motion or the plural foot motion.

A process of recognizing the foot motion corresponding to the sensor data can be also performed in the foot motion sense module 100. When the foot motion sense module 100 recognizes the foot motion corresponding to the sensor data, it recognizes the foot motion from the sensor data and then transmits the foot motion recognition result to the portable equipment 200, without transmitting the sensor data to the portable equipment 100.

Recognizing the foot motion, in Step 712, the portable equipment 200 performs the portable equipment function depending on the foot motion recognition result. In other words, the portable equipment 200 performs the portable equipment function using the previously designated portable equipment manipulation command or function information in response to each recognized foot motion. For example, the portable equipment 200 can perform the tap dance, the melody musical instrument playing and the music player functions, depending on the previously designated portable equipment manipulation command or function information, in response to each foot motion.

Figure 8:
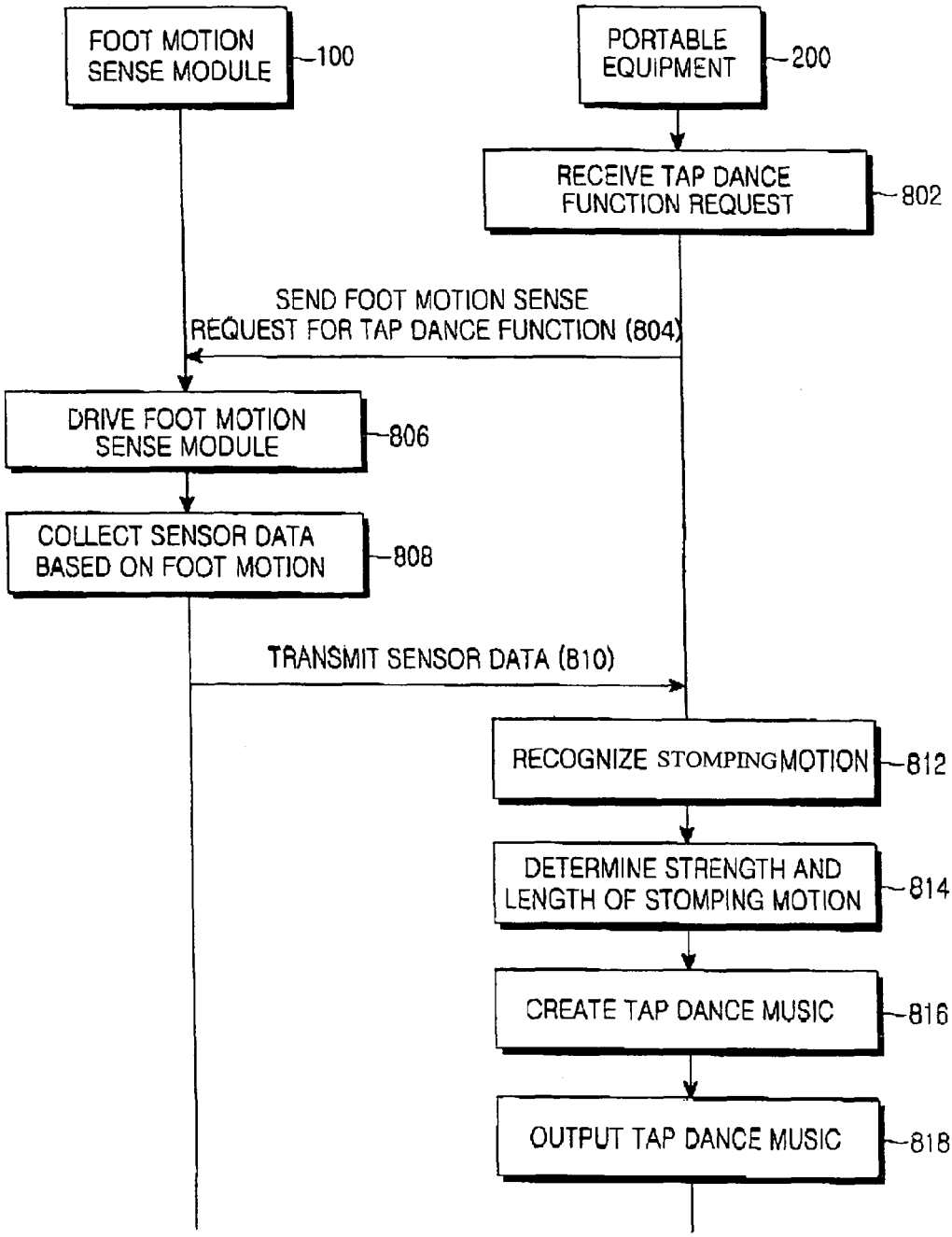
FIG. 8 is a ladder diagram illustrating a method for performing a tap dance function for manipulating portable equipment using a foot motion according to the present invention.

FIG. 8 is a ladder diagram illustrating the method for performing the tap dance function in the system for manipulating the portable equipment using the foot motion according to the present invention.

Referring to FIG. 8, the portable equipment 200 receives a request for the tap dance function from the user in Step 802. Upon the receipt of this request, the portable equipment 200 transmits a foot motion sense request signal for the tap dance function to the foot motion sense module 100 in Step 804. When there is sufficient contact by the user, the foot motion sense module 100 can also self-recognize it as the foot motion sense request for the tap dance function, using the driver 110 including the contact and/or magnetic sensor or switch. When there is a foot motion sense request for the tap dance function, the foot motion sense module 100 is driven using the driver 110 in Step 806.

The foot motion sense module 100 collects the sensor data based on the foot motion using the sensing unit 120 in Step 808. For example, the foot motion sense module 100 collects the pressure sensor data, the impact sensor data, the geomagnetic sensor data and the acceleration sensor data based on the foot motion, using the sensing unit 120.

In Step 810, the foot motion sense module 100 transmits the respective collected sensor data to the portable equipment 200 using the local area radio communication. The foot motion sense module 100 can use the local area radio communication such as infrared communication, ZigBee™ communication and Bluetooth® communication.

Upon receipt of the sensor data from the foot motion sense module 100, in Step 812, the portable equipment 200 recognizes a stomping motion corresponding to a tap dance, from the sensor data. For example, the portable equipment 200 previously stores a sensor critical value for determining the stomping motion corresponding to the tap dance, and recognizes the foot motion as the stomping motion corresponding to the tap dance when the collected sensor data corresponds to the previously stored sensor critical value.

A process of recognizing the stomping motion corresponding to the tap dance can be also performed in the foot motion sense module 100. When the foot motion sense module 100 recognizes the stomping motion corresponding to the tap dance, it recognizes it from the sensor data and then transmits the recognition result to the portable equipment 200, without transmitting the sensor data to the portable equipment 100.

In Step 814, the portable equipment 200 determines a strength and a length of the recognized stomping motion. In other words, the portable equipment 200 determines with how much force the stomping motion is made and for how long the stomping motion persists.

In Step 816, the portable equipment 200 creates the tap dance music depending on the strength and the length of each stomping motion. The portable equipment 200 previously stores a tap dance sound source corresponding to each strength and length of the stomping motion, and combines the tap dance sound sources corresponding to the strengths and the lengths of the stomping motions with each other, to create the tap dance music.

In Step 818, the portable equipment 200 outputs the tap dance music by the speaker using the audio unit 216. The portable equipment 200 can also store the tap dance music in the memory 210, and output the stored tap dance music upon user's request.

Figure 9:
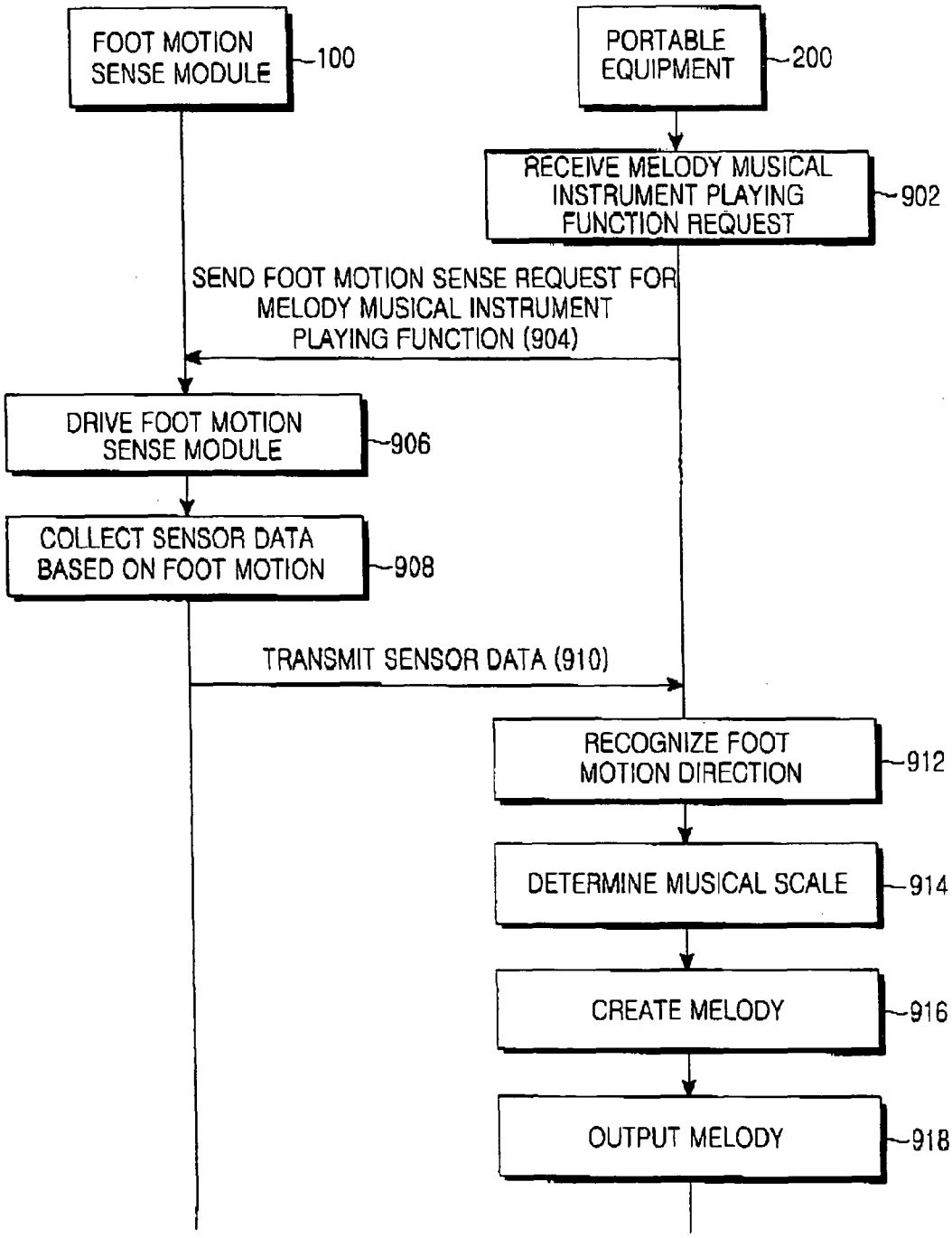
FIG. 9 is a ladder diagram illustrating a method for performing a melody musical instrument playing function for manipulating portable equipment using a foot motion according to the present invention.

FIG. 9 is a ladder diagram illustrating the method for performing the melody musical instrument playing function in the system for manipulating the portable equipment using the foot motion according to the present invention.

Referring to FIG. 9, the portable equipment 200 receives a request for the melody musical instrument playing function from the user in Step 902. Upon the receipt of this request, the portable equipment 200 transmits a foot motion sense request signal for the melody musical instrument playing function to the foot motion sense module 100 in Step 904. When there is sufficient contact by the user, the foot motion sense module 100 can also self-recognize it as the foot motion sense request for the melody musical instrument playing function, using the driver 110 including the contact and/or magnetic sensor or switch.

Upon the receipt of the foot motion sense request for the melody musical instrument playing function, the foot motion sense module 100 is driven using the driver 110 in Step 906. The foot motion sense module 100 collects the sensor data based on the foot motion using the sensing unit 120 in Step 908. For example, the foot motion sense module 100 collects the pressure sensor data, the impact sensor data, the geomagnetic sensor data and the acceleration sensor data based on the foot motion, using the sensing unit 120.

In Step 910, the foot motion sense module 100 transmits the respective collected sensor data to the portable equipment 200 using the local area radio communication. The foot motion sense module 100 can use the local area radio communication such as infrared communication, ZigBee™ communication and Bluetooth® communication.

Upon the receipt of the sensor data from the foot motion sense module 100, in Step 912, the portable equipment 200 recognizes a foot motion direction corresponding to the melody musical instrument playing function from the sensor data. For example, the portable equipment 200 previously stores a sensor critical value for determining the foot motion direction corresponding to the melody musical instrument playing function, and recognizes the foot motion as the foot motion direction corresponding to the melody musical instrument playing function when the collected sensor data corresponds to the previously stored sensor critical value.

A process of recognizing the foot motion direction corresponding to the melody musical instrument playing function can be also performed in the foot motion sense module 100. When the foot motion sense module 100 recognizes the foot motion direction corresponding to the melody musical instrument playing function, it recognizes the foot motion direction corresponding to the melody musical instrument playing function from the sensor data and then transmits the recognition result to the portable equipment 200, without transmitting the sensor data to the portable equipment 100.

In Step 914, the portable equipment 200 determines musical scales corresponding to the respective recognized foot motion directions, using previously stored musical scales.

For example, the portable equipment 200 stores eight-scale, such as Do, Re, Mi, Fa, Sol, La, Ti, Do, associated with four forth and back, left and right directions and four diagonal directions between those four directions, and determines the scales corresponding to the respective foot motion directions.

After that, in Step 916, the portable equipment 200 creates a melody depending on the scale corresponding to the foot motion direction.

In Step 918, the portable equipment 200 outputs the created melody by the speaker, using the audio unit 216. The portable equipment 200 can also store the created melody in the memory 210, and output the stored melody upon a user's request.

Figure 10:
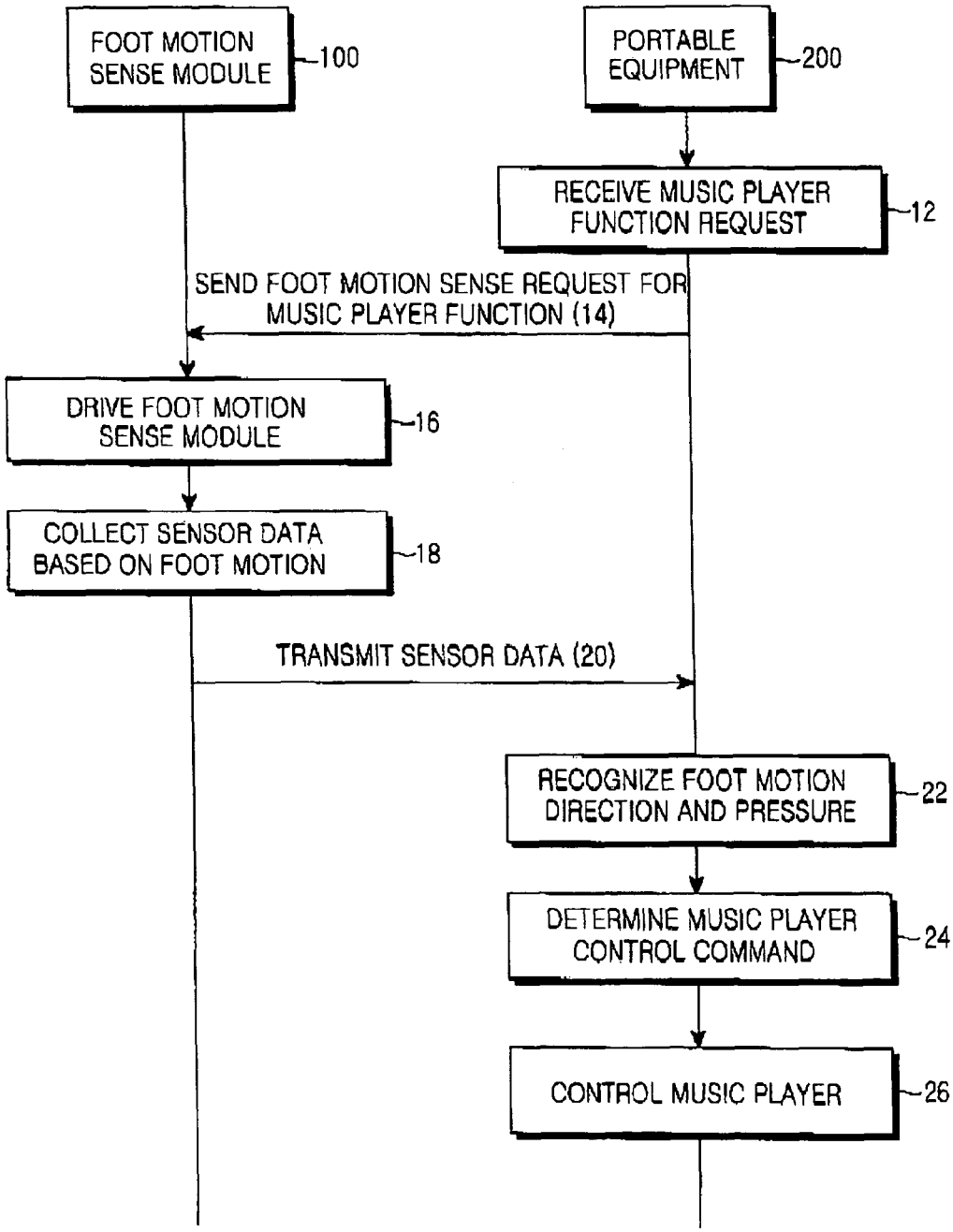
FIG. 10 is a ladder diagram illustrating a method for performing a music player function for manipulating portable equipment using a foot motion according to the present invention.

FIG. 10 is a ladder diagram illustrating the method for performing the music player function in the system for manipulating the portable equipment using the foot motion according to the present invention.

Referring to FIG. 10, the portable equipment 200 receives a request for the music player function from the user in Step 12. Upon receipt of this request, the portable equipment 200 transmits a foot motion sense request signal for the music player function to the foot motion sense module 100 in Step 14. When there is sufficient contact by the user, the foot motion sense module 100 can also self-recognize it as the foot motion sense request for the music player function, using the driver 110 including the contact and/or magnetic sensor or switch. When there is the foot motion sense request for the music player function, the foot motion sense module 100 is driven using the driver 110 in Step 16.

The foot motion sense module 100 collects the sensor data based on the foot motion using the sensing unit 120 in Step 18. For example, the foot motion sense module 100 collects the pressure sensor data, the impact sensor data, the geomagnetic sensor data and the acceleration sensor data based on the foot motion, using the sensing unit 120.

In Step 20, the foot motion sense module 100 transmits the respective collected sensor data to the portable equipment 200 using the local area radio communication. The foot motion sense module 100 can use the local area radio communication such as infrared communication, ZigBee™ communication and Bluetooth® communication.

Upon the receipt of the sensor data from the foot motion sense module 100, in Step 22, the portable equipment 200 recognizes foot motion direction and pressure corresponding to the music player function from the sensor data. For example, the portable equipment 200 previously stores a sensor critical value for determining the foot motion direction and pressure corresponding to the music player function, and recognizes the foot motion as the foot motion direction and pressure corresponding to the music player function when the collected sensor data corresponds to the previously stored sensor critical value.

A process of recognizing the foot motion direction and pressure corresponding to the music player function can be also performed in the foot motion sense module 100. The foot motion sense module 100 recognizes the foot motion direction and pressure corresponding to the music player function from the sensor data and then transmits the recognition result to the portable equipment 200, without transmitting the sensor data to the portable equipment 100.

In Step 24, the portable equipment 200 determines a music player control command corresponding to each recognized foot motion direction and pressure, using a previously stored music player control command corresponding to the foot motion direction and pressure.

For example, the portable equipment 200 stores the music player control commands such as fast forward (FF), rewind (REW), PLAY, and STOP, associated with four directions forth and back, left and right, and pressures caused by the foot motions based on those four directions, and determines the music player control command corresponding to each foot motion direction and pressure. In Step 26, the portable equipment 200 performs the music player function in response to the music player control command.

As described above, in the present invention, even when the user does not use his or her hands to manipulate the portable equipment, the manipulation is performed in response to the foot motion. In the present invention, the foot motion is recognized to manipulate the portable equipment, thereby increasing freedom of manipulation of the respective functions of the portable equipment and operating the respective functions with fun. In the present invention, the entertainment function of the portable equipment is controlled using the foot motion, thereby allowing the user to more enjoyably use the entertainment function. The present invention can be utilized as a utensil for user's music creation, by creating the tap dance music or creating the melody depending on the foot motion. In the present invention, the strength, length and melody of sound can be expressed using the foot motion, thereby allowing the user to create and play the music, controlling desired time, rhythm, tempo and accent by foot.

While the invention has been shown and described with reference to a certain preferred embodiment thereof, it will be understood by those skilled in the art that various changes in form and details may be made therein without departing from the spirit and scope of the invention as defined by the appended claims. For example, in the present invention, several single foot motions and plural foot motions are described as one example, but several other single foot motions and plural foot motions than the above described foot motions can be used.

In the present invention, the methods for controlling the tap dance function, the melody musical instrument playing function, and the music player function, and manipulating the portable equipment using the foot motion are described, but are also applicable to all functions that can be performed by the portable equipment, such as a call function, a scheduling function, a TV viewing function and an alarming function, other than the above functions.

What is claimed is:

1. A system for manipulating portable equipment using a foot motion, the system comprising:

a foot motion sense module for sensing a user's foot motion, and collecting sensor data based on the user's foot motion; and the portable equipment for driving of the foot motion sense module to perform a portable equipment function corresponding to a received request when a request for one of a plurality of portable equipment functions performed according to a foot motion is received, receiving the sensor data based on the user's foot motion, recognizing the foot motion, and performing the requested portable equipment function depending on a foot motion recognition result;

wherein the portable equipment comprises a controller for performing the portable equipment function in response to the foot motion recognition result, and wherein, when the foot motion is recognized, the controller performs a manipulation command or function depending on a previously stored portable equipment manipulation command and function information corresponding to the foot motion when the foot motion is recognized, wherein the foot motion sense module comprises:

a sensing unit for sensing the user's foot motion, and outputting the sensor data based on the foot motion, a controller for controlling and collecting the sensor data based on the foot motion, and transmitting the collected sensor data based on the foot motion to the portable equipment, and a local area radio communication unit for transmitting the sensor data to the portable equipment using a local area radio communication, and wherein the sensing unit comprises:

a pressure sensor for sensing a pressure based on the foot motion, and outputting pressure sensor data corresponding to the sensed pressure, an impact sensor for sensing an impact based on the foot motion, and outputting impact sensor data corresponding to the sensed impact, a gyro sensor for sensing foot motion direction, and outputting gyro sensor data corresponding to the sensed foot motion direction; and an acceleration sensor for sensing a foot motion speed, and outputting acceleration sensor data corresponding to the sensed foot motion speed.

2. The system of claim 1, wherein the foot motion sense module recognizes the foot motion using the sensor data based on the foot motion, and provides the foot motion recognition result to the portable equipment.

3. The system of claim 1, wherein the controller controls and recognizes the foot motion from the collected sensor data based on the foot motion, and transmits the foot motion recognition result to the portable equipment.

4. The system of claim 1, further comprising a memory for storing the sensor data based on the foot motion.

5. The system of claim 1, further comprising a driver for driving the foot motion sense module in response to a user's foot motion sense request.

6. The system of claim 5, wherein the user's foot motion sense request is received from the portable equipment.

7. The system of claim 5, wherein the user's foot motion sense request is recognized and received by the foot motion sense module.

8. The system of claim 1, wherein the local area radio communication unit performs the local area radio communication with the portable equipment using one of an infrared communication means, a ZigBee™ communication means and a Bluetooth® communication means.

9. The system of claim 1, wherein the portable equipment further comprises:

a local area radio communication unit for receiving the sensor data based on the foot motion, from the foot motion sense module; and a foot motion recognizing unit for recognizing the foot motion using the received sensor data based on the foot motion.

10. The system of claim 9, wherein the local area radio communication unit performs a local area radio communication with the portable equipment using one of an infrared communication means, a ZigBee™ communication means and a Bluetooth® communication means.

11. The system of claim 9, wherein the foot motion recognizing unit previously stores a sensor critical value based on each foot motion, and recognizes execution of the foot motion when a sensor data value corresponds to the previously stored sensor critical value.

12. The system of claim 9, wherein the foot motion recognizing unit recognizes a single foot motion.

13. The system of claim 9, wherein the foot motion recognizing unit recognizes a plurality of foot motions.

14. A system for manipulating portable equipment using a foot motion, the system comprising:

a foot motion sense module for sensing a user's foot motion, and collecting sensor data based on the user's foot motion; and the portable equipment for driving of the foot motion sense module to perform a portable equipment function corresponding to a received request when a request for one of a plurality of portable equipment functions performed according to a foot motion is received, receiving the sensor data based on the user's foot motion, recognizing the foot motion, and performing the requested portable equipment function depending on a foot motion recognition result;

wherein the portable equipment comprises a controller for performing the portable equipment function in response to the foot motion recognition result, wherein, when the foot motion is recognized, the controller performs a manipulation command or function depending on a previously stored portable equipment manipulation command and function information corresponding to the foot motion when the foot motion is recognized, and wherein the portable equipment manipulation command and function information corresponding to the foot motion includes at least one of a tap dance function, a melody musical instrument playing function and a music player function.

15. A method for performing a portable equipment function in portable equipment, the method comprising steps of:

starting driving of a foot motion sense module for performing a portable equipment function corresponding to a request for one of a plurality of portable equipment functions performed according to when a foot motion is received;

receiving sensor data based on a user's foot motion so as to manipulate the portable equipment from the foot motion sense module;

recognizing the foot motion using the received sensor data based on the user's foot motion;

performing the requested portable equipment function corresponding to the recognized foot motion;

sensing a pressure and an impact caused by the user's foot motion, a foot motion direction, and a foot motion speed; and collecting pressure sensor data, impact sensor data, geomagnetic sensor data and acceleration sensor data based on the foot motion, as a sensed result.

16. The method of claim 15, further comprising receiving a user's foot motion sense request.

17. The method of claim 16, wherein the user's foot motion sense request is received from the portable equipment.

18. The method of claim 16, wherein the user's foot motion sense request is received by the foot motion sense module.

19. The method of claim 15, wherein recognizing the foot motion using the sensor data based on the user's foot motion further comprises:

determining whether a sensor data value based on the foot motion corresponds to a previously stored sensor critical value based on the foot motion; and recognizing the foot motion when the sensor data value based on the foot motion corresponds to the previously stored sensor critical value based on the foot motion.

20. The method of claim 19, wherein the foot motion is a single foot motion.

21. The method of claim 19, wherein the foot motion is a plurality of foot motions.

22. The method of claim 15, wherein performing the portable equipment function depending on the foot motion recognition result further comprises performing one of a tap dance function, a melody musical instrument playing function and a music player function, in response to the foot motion recognition result.

23. A method for performing a portable equipment function corresponding to one of a plurality of portable equipment functions of a portable equipment, the method comprising steps of receiving sensor data based on a user's foot motion so as to manipulate the portable equipment from a foot motion sense module;

recognizing the foot motion using the received sensor data based on the user's foot motion; and performing a tap dance function among the plurality of portable equipment functions of the portable equipment in response to the foot motion recognition result, wherein performing the tap dance function depending on the foot motion recognition result further comprises:

determining a strength and a length of a stomping motion, and creating a tap dance music in response to the strength and the length of the stomping motion.

24. The method of claim 23, further comprising outputting the created tap dance music.

25. The method of claim 24, further comprising storing the created tap dance music.

26. A method for performing a portable equipment function corresponding to one of a plurality of portable equipment functions of a portable equipment, the method comprising steps of:

receiving sensor data based on a user's foot motion so as to manipulate the portable equipment from a foot motion sense module;

recognizing the foot motion using the received sensor data based on the user's foot motion; and performing a melody musical instrument playing function of the plurality of portable equipment functions of the portable equipment in response to the foot motion recognition result, wherein performing the melody musical instrument playing function in response to the foot motion recognition result further comprises:

determining a scale corresponding to a foot motion direction; and creating a melody depending on the scale corresponding to the foot motion direction.

27. The method of claim 26, further comprising outputting the created melody.

28. The method of claim 27, further comprising storing the created melody.

29. A method for performing a portable equipment function corresponding to one of a plurality of portable equipment functions of a portable equipment, the method comprising steps of:

receiving sensor data based on a user's foot motion so as to manipulate the portable equipment from a foot motion sense module;

recognizing the foot motion using the received sensor data based on the user's foot motion; and performing a music player function of the plurality of portable equipment functions of the portable equipment in response to the foot motion recognition result, wherein performing the music player function depending on the foot motion recognition result further comprises:

determining a music player control command corresponding to recognized foot motion direction and pressure; and performing the music player function, in response to the music player control command corresponding to the foot motion direction and pressure.

30. The method of claim 29, wherein the music player control command comprises FF (fast forward), REW (rewind), PLAY and STOP commands.

* * * * *